US011602835B2

(12) United States Patent
Woodland

(10) Patent No.: US 11,602,835 B2
(45) Date of Patent: Mar. 14, 2023

(54) FOAM CUTTING TABLE

(71) Applicant: Jason McSpadden Woodland, Pocatello, ID (US)

(72) Inventor: Jason McSpadden Woodland, Pocatello, ID (US)

( * ) Notice: Subject to any disclaimer, the term of this patent is extended or adjusted under 35 U.S.C. 154(b) by 0 days.

(21) Appl. No.: 17/338,701

(22) Filed: Jun. 4, 2021

(65) Prior Publication Data

US 2021/0379753 A1 Dec. 9, 2021

Related U.S. Application Data

(60) Provisional application No. 63/034,559, filed on Jun. 4, 2020.

(51) Int. Cl.
*B25H 1/02* (2006.01)
*B25H 1/06* (2006.01)

(52) U.S. Cl.
CPC ..... *B25H 1/02* (2013.01); *B25H 1/06* (2013.01)

(58) Field of Classification Search
CPC ..... B25H 1/02; B25H 1/00; B25H 1/0007
USPC ..... 269/900, 901.289 R, 266
See application file for complete search history.

(56) References Cited

U.S. PATENT DOCUMENTS

| | | | | |
|---|---|---|---|---|
| 2,911,265 | A * | 11/1959 | Hannah | A47B 3/12 D25/67 |
| 6,206,356 | B1 * | 3/2001 | Beloff | A47J 47/005 269/302.1 |
| 7,156,386 | B1 * | 1/2007 | Johnson | A47J 47/005 269/302.1 |
| 8,727,327 | B2 * | 5/2014 | Miller | F16M 11/02 269/244 |
| 2011/0036456 | A1 * | 2/2011 | Ishida | B25H 1/02 144/363 |
| 2019/0118368 | A1 * | 4/2019 | Henderson | B23Q 3/02 |

* cited by examiner

*Primary Examiner* — Joseph J Hail
*Assistant Examiner* — Robert C Moore
(74) *Attorney, Agent, or Firm* — Kirton McConkie; Adam D. Stevens

(57) ABSTRACT

The present device is a cutting table for supporting a workpiece above a support surface while cutting the workpiece with a tool. The cutting table is comprised of at least one foam table piece that includes a top side, a bottom side, and at least one peripheral edge. Two or more foam standoffs project upwardly from the top side of the foam table piece a common height and each terminate at a top surface adapted for contacting and supporting the workpiece. The two or more standoffs allow the workpiece, when supported by the foam table piece, to be cut with the tool even if some of the standoffs are damaged by the tool. Preferably a portion of the area of the top surfaces of the standoffs to an area of the top side of the foam table pieces is less than 50%, preferably being between either 20-30% or 45-50%.

21 Claims, 4 Drawing Sheets

FOAM CUTTING TABLE

CROSS-REFERENCE TO RELATED APPLICATIONS

This application claims the benefit of U.S. Provisional Application No. 63/034,559, filed Jun. 4, 2020.

BACKGROUND OF THE INVENTION

1. Field of the Invention

The present invention relates to cutting tables and saw horses, and more particularly to a foam cutting table.

2. Background and Related Art

Sawhorses, tables, and other structures used to support a workpiece while for cutting with a tool have several problems. One such problem is that they can be damaged with whatever tool is being used on the workpiece, whether it's a drill or a hand saw or some other tool. The sawhorse or table can be cut or damaged as the tool cuts through the workpiece. Or, worse yet, the tool itself could be damaged as it makes sudden contact with the support surface of the possibly more-rigid sawhorse.

Therefore, there is a need for a device that can support a workpiece during cutting with a tool. Such a needed device also remain functional, even if part of it is damaged by the tool being used. Such an invention would not damage the tool when the tool inevitably cuts through the workpiece. The present invention accomplishes these objectives.

BRIEF SUMMARY OF THE INVENTION

Implementation of the invention provides a cutting table that is adapted to support a workpiece during cutting with a tool. The cutting table in accordance with implementations of the invention remains functional even if a part of the cutting table is damaged by the tool being used to cut the workpiece. The cutting table in accordance with implementations of the invention does not damage the tool used to cut the workpiece, even if the tool cuts through the workpiece and even if the tool cuts into the cutting table.

According to certain implementations of the invention, a cutting table for supporting a workpiece while cutting the workpiece with a tool includes at least one table piece that includes a top side and a bottom side, and two or more standoffs projecting upwardly from the top side of the at least one table piece and each standoff terminating at a generally common top plane, the standoffs being adapted for contacting and supporting a workpiece. With the workpiece supported on the standoffs, the workpiece may be cut with the tool, the workpiece supported by standoffs even if one or more of the standoffs has been damaged by the tool.

In some implementations, the two or more standoffs include a stiff material providing minimal cutting resistance to the tool cutting the workpiece. In some implementations, the stiff material providing minimal cutting resistance includes expanded polystyrene (EPS) foam. In some implementations, the stiff material providing minimal cutting resistance includes a material such as polyisocyanurate foam, EPS foam, extruded polystyrene (XPS) foam, or a cellulosic-base elastic foam material. In some implementations, the entire table piece, including the two or more standoffs, is formed of a stiff material providing minimal cutting resistance to the tool cutting the workpiece. In some implementations, the stiff material providing minimal cutting resistance includes EPS foam. In some implementations, the stiff material providing minimal cutting resistance includes a material such as polyisocyanurate foam, EPS foam, XPS foam, or a cellulosic-base elastic foam material.

In some implementations, the two or more standoffs include a grid of standoffs spaced in a pattern across the top side of the table piece. In some implementations, the standoffs are spaced generally equidistantly across the top side of the table piece. In some implementations, an area of the standoffs at the generally common top plane includes between approximately 10% and approximately 40% of an area of the bottom side of the table piece. In some implementations, an area of the standoffs at the generally common top plane includes between approximately 20% and approximately 30% of an area of the bottom side of the table piece.

In some implementations, the cutting table is formed of at least two table pieces, the table pieces having substantially equal thicknesses, and each table piece including standoffs disposed in a complementary pattern such that standoffs of a first of the table pieces are spaced to fit in spaces between standoffs of a second of the table pieces when the second of the table pieces is inverted and disposed above the first of the table pieces, such that the standoffs of the first of the table pieces are adapted to nest among the standoffs of the second of the table pieces such that the first of the table pieces and the second of the table pieces are adapted to be nested atop one another having a combined thickness less than twice the thickness of the table pieces.

In some implementations, each table piece includes a part of a complementary snap joint along a peripheral edge thereof, adjacent table pieces are adapted to snap together at their complementary snap joints, and when adjacent table pieces are snapped together at their complementary snap joints, the grid of standoffs of a first adjacent table piece extends into the grid of standoffs of a second adjacent table piece as a contiguous grid of standoffs. In some implementations, the cutting table includes a support surface adapted to support the adjacent table pieces in a substantially planar configuration and one or more legs adapted to support the support surface above an underlying surface such that the generally common top plane of the standoffs is disposed at a convenient cutting height. In some implementations, each of the one or more legs includes a channel sized and shaped to receive a first portion of a board of lumber therein to form the support surface and each of the table pieces includes a complementary channel formed in the bottom side thereof that is sized and shaped to receive a second portion of the board of lumber therein so as to secure the table pieces on the one or more legs against sliding motion in at least one generally horizontal direction.

According to certain implementations of the invention, a cutting table for supporting a workpiece above a support surface while cutting the workpiece with a tool, includes three foam table pieces that each includes a top side a bottom side and at least one peripheral edge including one part of a mechanical snap joint. One of the three foam pieces includes a second peripheral edge including one part of a mechanical snap joint such that the three foam table pieces can be joined at their respective parts of the mechanical snap joints to form a unitary foam table. The cutting table also includes a plurality of standoffs projecting upwardly from the top side of each foam table and each standoff terminating at a generally common top plane, the standoffs adapted for contacting and supporting a workpiece. With the workpiece supported on the standoffs, the workpiece may be cut with the tool, the workpiece supported by standoffs even if one or more of the standoffs has been damaged by the tool.

In some implementations, the cutting table also includes a support surface adapted to support the adjacent table pieces in a substantially planar configuration and one or more legs adapted to support the support surface above an underlying surface such that the generally common top plane of the standoffs is disposed at a convenient cutting height. In some implementations, each of the one or more legs includes a channel sized and shaped to receive a first portion of a board of lumber therein to form the support surface and each of the table pieces includes a complementary channel formed in the bottom side thereof that is sized and shaped to receive a second portion of the board of lumber therein so as to secure the table pieces on the one or more legs against sliding motion in at least one generally horizontal direction.

In some implementations, the standoffs include a stiff material providing minimal cutting resistance to the tool cutting the workpiece. In some implementations, the stiff material providing minimal cutting resistance includes EPS foam. In some implementations, the stiff material providing minimal cutting resistance includes a material such as polyisocyanurate foam, EPS foam, XPS foam, or a cellulosic-base elastic foam material. In some implementations, the entire table piece, including the standoffs, is formed of a stiff material providing minimal cutting resistance to the tool cutting the workpiece. In some implementations, the stiff material providing minimal cutting resistance includes EPS foam. In some implementations, the stiff material providing minimal cutting resistance includes a material such as polyisocyanurate foam, EPS foam, XPS foam, or a cellulosic-base elastic foam material.

In some implementations, the standoffs include a grid of standoffs spaced in a pattern across the top side of the table piece. In some implementations, the standoffs are spaced generally equidistantly across the top side of the table piece. In some implementations, an area of the standoffs at the generally common top plane includes between approximately 10% and approximately 40% of an area of the bottom side of the table piece. In some implementations, an area of the standoffs at the generally common top plane includes between approximately 20% and approximately 30% of an area of the bottom side of the table piece.

According to certain implementations of the invention, a method for forming two pieces of a cutting table for supporting a workpiece above a support surface while cutting the workpiece with a tool, includes a step of providing a block of foam having a width equal to or greater than a width of a piece of a cutting table, a length equal to or greater than a length of the piece of the cutting table, and a thickness equal to or greater than twice a thickness of the piece of the cutting table. The method also includes a step of using a cutter to cut the block of foam in a contiguous cut extending across the width of the piece of the cutting table, the contiguous cut extending across the width of the piece of the cutting table including a series of width-oriented upper horizontal segments, a series of width-oriented lower horizontal segments, and a series of width-oriented vertical segments, each width-oriented vertical segment joining one edge of one width-oriented upper horizontal segment to an opposite edge of one width-oriented lower horizontal segment. The method further includes a step of using a cutter to cut the block of foam in a contiguous cut extending across the length of the piece of the cutting table, the contiguous cut extending across the length of the piece of the cutting table including a series of length-oriented upper horizontal segments, a series of length-oriented lower horizontal segments, and a series of length-oriented vertical segments, each length-oriented vertical segment joining one edge of one length-oriented upper horizontal segment to an opposite edge of one length-oriented lower horizontal segment. The contiguous cut extending across the width of the piece of the cutting table and the contiguous cut extending across the length of the piece of the cutting table form two pieces of the cutting table each having a plurality of standoffs extending from a top surface of a substantially planar body portion having a substantially planar bottom surface.

In some implementations, the method further includes using a cutter to form complementary respective parts of a mechanical snap joint in each of the two pieces of the cutting table and using a cutter to form a channel in the bottom surface of each piece of the cutting table, the channel being sized and shaped to receive a portion of a piece of lumber to support the pieces of the cutting table in a joined planar configuration.

Implementations of the present device provide a cutting table for supporting a workpiece above a support surface while cutting the workpiece with a tool. The cutting table is included of at least one foam table piece that includes a top side, a bottom side, and at least one peripheral edge. Two or more standoffs project upwardly a common height from the top side of the at least one foam table piece and each terminate at a top surface adapted for contacting and supporting the workpiece. The two or more standoffs allow the workpiece, when supported by the at least one foam table piece, to be cut with the tool even if some of the standoffs have been damaged by the tool. In some implementations a proportion of the area of the top surfaces of the standoffs to an area of the top side of the foam table pieces is less than 50%, such as between 20-30% or between 45-50%.

In some implementations, the cutting table that has at least one foam table piece includes at least two foam table pieces, where the at least one peripheral edge of each foam table piece is mutually joinable at a mechanical snap joint to form the cutting table. In some implementations, the at least one foam table piece include exactly three of the foam table pieces, two that are designated as outside table pieces with each having a first part of the mechanical snap joint, and one that is designated a center table piece and having two of a second part of the mechanical snap joint. The two outside table pieces are fixed with the center table piece by manually forcing the first part of the mechanical snap joint of each outside table piece to the second part of the mechanical snap joint of the center table piece.

One implementation of the cutting table further includes a pair of table legs fixable at the top end thereof with the bottom side of at least one foam table piece, whereby the cutting table is supported on the support surface by the table legs. In some implementations, the table legs each include at least one groove adapted for receiving a board of lumber, wherein the at least one foam table piece includes at least one inverted groove adapted for receiving the board of lumber, whereby the at least one foam table piece is stabilized on the table legs and the support surface. The board of lumber can be any size, but the board is a 2×4 in some implementations. One implementation includes exactly two of the grooves, so that the cutting table is stabilized by two of the boards of lumber.

Implementations of the present invention provide a device that can support a workpiece during cutting. Implementations of the present device remain functional, even if part of it is damaged by the tool. Implementations of the present invention also reduce the chance of the tool being used becoming damaged by contact with the foam of the present invention, as the foam presents minimal cutting resistance to the cutting tool. Other features and advantages of the present invention will become apparent from the following more detailed description, taken in conjunction with the accompanying drawings, which illustrate, by way of example, the principles of the invention.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
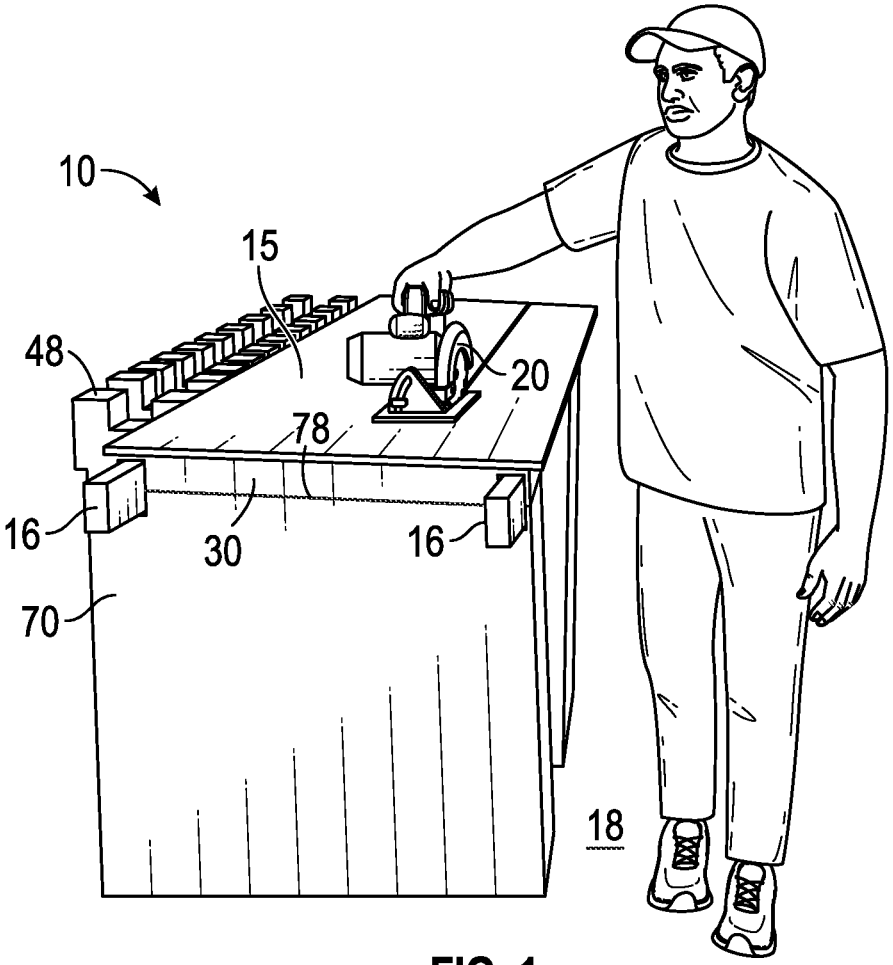
FIG. 1 shows a perspective view of an illustrative foam cutting table in use.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims. One skilled in the art will understand that embodiments of the invention may be practiced without the specific details described in the detailed description. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below," and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Embodiment of the invention provides a cutting table that is adapted to support a workpiece during cutting with a tool. The cutting table in accordance with embodiments of the invention remains functional even if a part of the cutting table is damaged by the tool being used to cut the workpiece. The cutting table in accordance with embodiments of the invention does not damage the tool used to cut the workpiece, even if the tool cuts through the workpiece and even if the tool cuts into the cutting table.

According to certain embodiments of the invention, a cutting table for supporting a workpiece while cutting the workpiece with a tool includes at least one table piece that includes a top side and a bottom side, and two or more standoffs projecting upwardly from the top side of the at least one table piece and each standoff terminating at a generally common top plane, the standoffs being adapted for contacting and supporting a workpiece. With the workpiece supported on the standoffs, the workpiece may be cut with the tool, the workpiece supported by standoffs even if one or more of the standoffs has been damaged by the tool.

In some embodiments, the two or more standoffs include a stiff material providing minimal cutting resistance to the tool cutting the workpiece. In some embodiments, the stiff material providing minimal cutting resistance includes expanded polystyrene (EPS) foam. In some embodiments, the stiff material providing minimal cutting resistance includes a material such as polyisocyanurate foam, EPS foam, extruded polystyrene (XPS) foam, or a cellulosic-base elastic foam material. In some embodiments, the entire table piece, including the two or more standoffs, is formed of a stiff material providing minimal cutting resistance to the tool cutting the workpiece. In some embodiments, the stiff material providing minimal cutting resistance includes EPS foam. In some embodiments, the stiff material providing minimal cutting resistance includes a material such as polyisocyanurate foam, EPS foam, XPS foam, or a cellulosic-base elastic foam material.

In some embodiments, the two or more standoffs include a grid of standoffs spaced in a pattern across the top side of the table piece. In some embodiments, the standoffs are spaced generally equidistantly across the top side of the table piece. In some embodiments, an area of the standoffs at the generally common top plane includes between approximately 10% and approximately 40% of an area of the bottom side of the table piece. In some embodiments, an area of the standoffs at the generally common top plane includes between approximately 20% and approximately 30% of an area of the bottom side of the table piece.

In some embodiments, the cutting table is formed of at least two table pieces, the table pieces having substantially equal thicknesses, and each table piece including standoffs disposed in a complementary pattern such that standoffs of a first of the table pieces are spaced to fit in spaces between standoffs of a second of the table pieces when the second of the table pieces is inverted and disposed above the first of the table pieces, such that the standoffs of the first of the table pieces are adapted to nest among the standoffs of the second of the table pieces such that the first of the table pieces and the second of the table pieces are adapted to be nested atop one another having a combined thickness less than twice the thickness of the table pieces.

In some embodiments, each table piece includes a part of a complementary snap joint along a peripheral edge thereof, adjacent table pieces are adapted to snap together at their complementary snap joints, and when adjacent table pieces are snapped together at their complementary snap joints, the grid of standoffs of a first adjacent table piece extends into the grid of standoffs of a second adjacent table piece as a contiguous grid of standoffs. In some embodiments, the cutting table includes a support surface adapted to support the adjacent table pieces in a substantially planar configuration and one or more legs adapted to support the support surface above an underlying surface such that the generally common top plane of the standoffs is disposed at a convenient cutting height. In some embodiments, each of the one or more legs includes a channel sized and shaped to receive a first portion of a board of lumber therein to form the support surface and each of the table pieces includes a complementary channel formed in the bottom side thereof that is sized and shaped to receive a second portion of the board of lumber therein so as to secure the table pieces on the one or more legs against sliding motion in at least one generally horizontal direction.

According to certain embodiments of the invention, a cutting table for supporting a workpiece above a support surface while cutting the workpiece with a tool, includes three foam table pieces that each includes a top side a bottom side and at least one peripheral edge including one part of a mechanical snap joint. One of the three foam pieces includes a second peripheral edge including one part of a mechanical snap joint such that the three foam table pieces can be joined at their respective parts of the mechanical snap joints to form a unitary foam table. The cutting table also includes a plurality of standoffs projecting upwardly from the top side of each foam table and each standoff terminating at a generally common top plane, the standoffs adapted for contacting and supporting a workpiece. With the workpiece supported on the standoffs, the workpiece may be cut with the tool, the workpiece supported by standoffs even if one or more of the standoffs has been damaged by the tool.

In some embodiments, the cutting table also includes a support surface adapted to support the adjacent table pieces in a substantially planar configuration and one or more legs adapted to support the support surface above an underlying surface such that the generally common top plane of the standoffs is disposed at a convenient cutting height. In some embodiments, each of the one or more legs includes a channel sized and shaped to receive a first portion of a board of lumber therein to form the support surface and each of the table pieces includes a complementary channel formed in the bottom side thereof that is sized and shaped to receive a second portion of the board of lumber therein so as to secure the table pieces on the one or more legs against sliding motion in at least one generally horizontal direction.

In some embodiments, the standoffs include a stiff material providing minimal cutting resistance to the tool cutting the workpiece. In some embodiments, the stiff material providing minimal cutting resistance includes EPS foam. In some embodiments, the stiff material providing minimal cutting resistance includes a material such as polyisocyanurate foam, EPS foam, XPS foam, or a cellulosic-base elastic foam material. In some embodiments, the entire table piece, including the standoffs, is formed of a stiff material providing minimal cutting resistance to the tool cutting the workpiece. In some embodiments, the stiff material providing minimal cutting resistance includes EPS foam. In some embodiments, the stiff material providing minimal cutting resistance includes a material such as polyisocyanurate foam, EPS foam, XPS foam, or a cellulosic-base elastic foam material.

In some embodiments, the standoffs include a grid of standoffs spaced in a pattern across the top side of the table piece. In some embodiments, the standoffs are spaced generally equidistantly across the top side of the table piece. In some embodiments, an area of the standoffs at the generally common top plane includes between approximately 10% and approximately 40% of an area of the bottom side of the table piece. In some embodiments, an area of the standoffs at the generally common top plane includes between approximately 20% and approximately 30% of an area of the bottom side of the table piece.

According to certain embodiments of the invention, a method for forming two pieces of a cutting table for supporting a workpiece above a support surface while cutting the workpiece with a tool, includes a step of providing a block of foam having a width equal to or greater than a width of a piece of a cutting table, a length equal to or greater than a length of the piece of the cutting table, and a thickness equal to or greater than twice a thickness of the piece of the cutting table. The method also includes a step of using a cutter to cut the block of foam in a contiguous cut extending across the width of the piece of the cutting table, the contiguous cut extending across the width of the piece of the cutting table including a series of width-oriented upper horizontal segments, a series of width-oriented lower horizontal segments, and a series of width-oriented vertical segments, each width-oriented vertical segment joining one edge of one width-oriented upper horizontal segment to an opposite edge of one width-oriented lower horizontal segment. The method further includes a step of using a cutter to cut the block of foam in a contiguous cut extending across the length of the piece of the cutting table, the contiguous cut extending across the length of the piece of the cutting table including a series of length-oriented upper horizontal segments, a series of length-oriented lower horizontal segments, and a series of length-oriented vertical segments, each length-oriented vertical segment joining one edge of one length-oriented upper horizontal segment to an opposite edge of one length-oriented lower horizontal segment. The contiguous cut extending across the width of the piece of the cutting table and the contiguous cut extending across the length of the piece of the cutting table form two pieces of the cutting table each having a plurality of standoffs extending from a top surface of a substantially planar body portion having a substantially planar bottom surface.

In some embodiments, the method further includes using a cutter to form complementary respective parts of a mechanical snap joint in each of the two pieces of the cutting table and using a cutter to form a channel in the bottom surface of each piece of the cutting table, the channel being sized and shaped to receive a portion of a piece of lumber to support the pieces of the cutting table in a joined planar configuration.

Embodiments of the present device provide a cutting table for supporting a workpiece above a support surface while cutting the workpiece with a tool. The cutting table is included of at least one foam table piece that includes a top side, a bottom side, and at least one peripheral edge. Two or more standoffs project upwardly a common height from the top side of the at least one foam table piece and each terminate at a top surface adapted for contacting and supporting the workpiece. The two or more standoffs allow the workpiece, when supported by the at least one foam table piece, to be cut with the tool even if some of the standoffs have been damaged by the tool. In some embodiments a proportion of the area of the top surfaces of the standoffs to an area of the top side of the foam table pieces is less than 50%, such as between 20-30% or between 45-50%.

In some embodiments, the cutting table that has at least one foam table piece includes at least two foam table pieces, where the at least one peripheral edge of each foam table piece is mutually joinable at a mechanical snap joint to form the cutting table. In some embodiments, the at least one foam table piece include exactly three of the foam table pieces, two that are designated as outside table pieces with each having a first part of the mechanical snap joint, and one that is designated a center table piece and having two of a second part of the mechanical snap joint. The two outside table pieces are fixed with the center table piece by manually forcing the first part of the mechanical snap joint of each outside table piece to the second part of the mechanical snap joint of the center table piece.

One embodiment of the cutting table further includes a pair of table legs fixable at the top end thereof with the bottom side of at least one foam table piece, whereby the cutting table is supported on the support surface by the table legs. In some embodiments, the table legs each include at least one groove adapted for receiving a board of lumber, wherein the at least one foam table piece includes at least one inverted groove adapted for receiving the board of lumber, whereby the at least one foam table piece is stabilized on the table legs and the support surface. The board of lumber can be any size, but the board is a 2×4 in some embodiments. One embodiment includes exactly two of the grooves, so that the cutting table is stabilized by two of the boards of lumber.

Embodiments of the present invention provide a device that can support a workpiece during cutting. Embodiments of the present device remain functional, even if part of it is damaged by the tool. Embodiments of the present invention also reduce the chance of the tool being used becoming damaged by contact with the foam of the present invention, as the foam presents minimal cutting resistance to the cutting tool. Other features and advantages of the present invention will become apparent from the following more detailed description, taken in conjunction with the accompanying drawings, which illustrate, by way of example, the principles of the invention.

FIG. 1 illustrates a cutting table 10 for supporting a workpiece 15 above a support surface 18, such as a ground surface, table, or the like, while cutting the workpiece 15 with a tool 20. The tool 20 can be a hand saw such as a circular saw, a drill, a router including a computer numerical control (CNC) router or other computer-controlled cutting tool, or any other suitable cutting tool.

The cutting table 10 includes of at least one foam table piece 30 that includes a top side 38, a bottom side 32, and at least one peripheral edge 35. Two or more standoffs 40 project upwardly a common height from the top side 38 of the at least one foam table piece 30. Each standoff 40 terminates at a top surface 48 adapted for contacting and supporting the workpiece 15. In some embodiments, the top surfaces 48 of the standoffs 40 form a generally common top plane particularly suitable for supporting generally planar materials during cutting. The standoffs 40 allow the workpiece 15, when on the at least one foam table piece 30, to be cut with the tool 20 even if some of the standoffs 40 become damaged by the tool 20. The foam material of the standoffs 40 maintains its shape even if adjacent portions of the standoff 40 are cut through by the tool 20, the foam material being, in some embodiments, expanded polystyrene (EPS) foam or similar semi-rigid foam materials such as extruded polystyrene foam (XPS), polyisocyanurate foam, and/or a cellulosic-base elastic foam material or some combination thereof.

Figure 2:
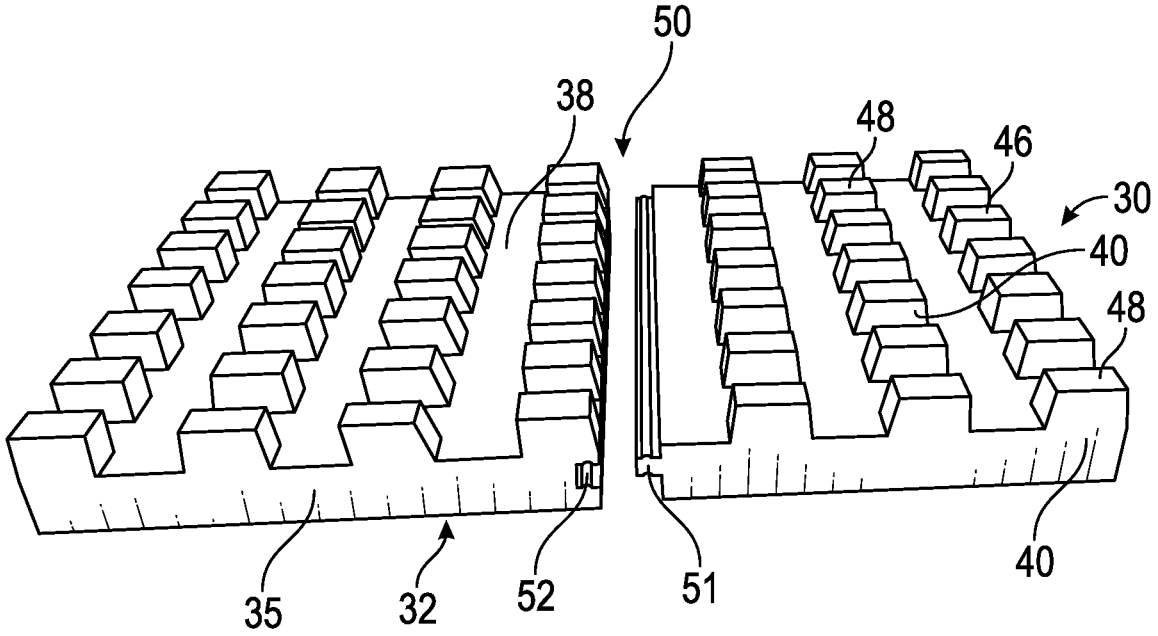
FIG. 2 shows a perspective view of a portion of the invention, illustrating two foam table pieces in a disconnected position.
Figure 3:
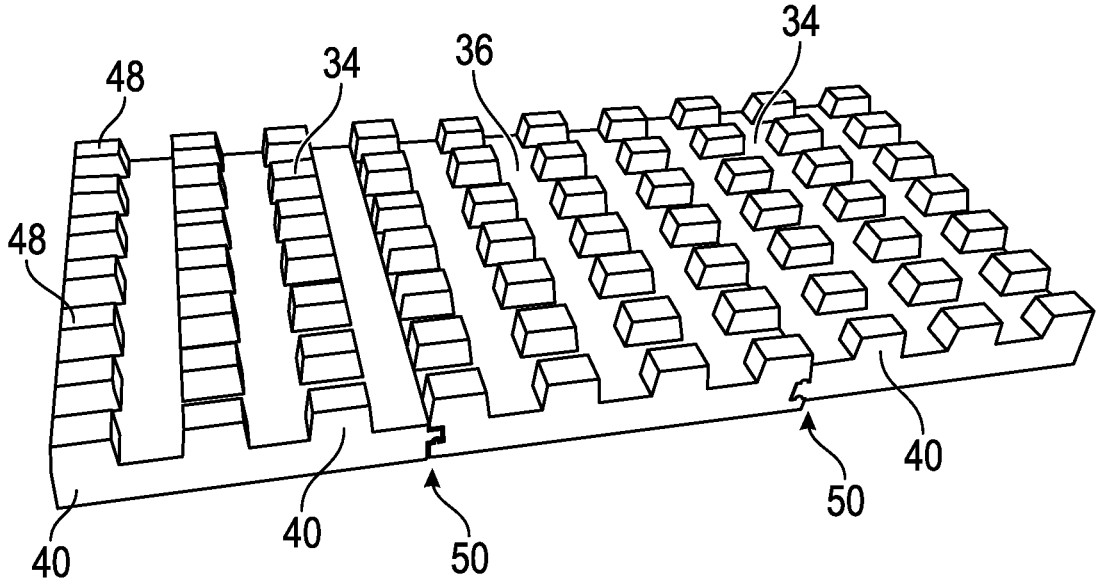
FIG. 3 shows a perspective view of a portion of the invention, illustrating three foam table pieces in a connected position.
Figure 4:
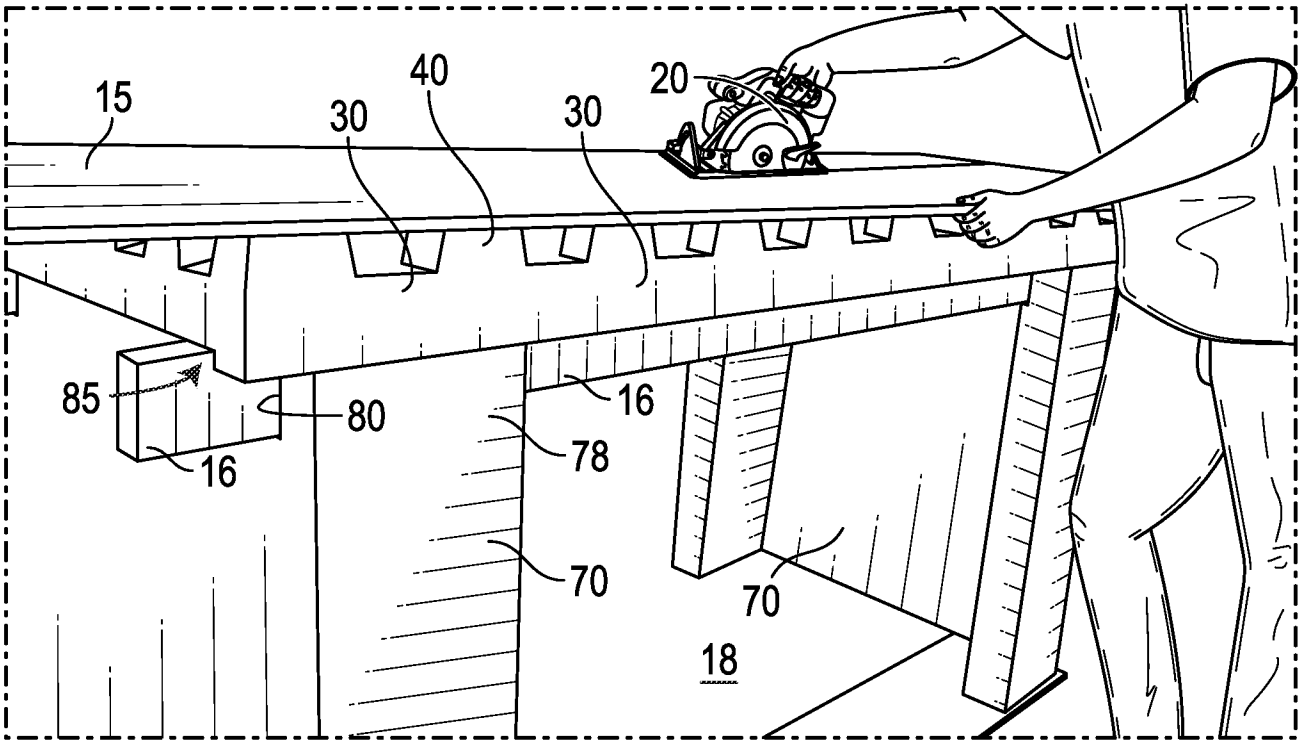
FIG. 4 shows a perspective view of a portion of a foam cutting table in use.

In some embodiments, the cutting table 10 includes at least two of the foam table pieces 30, wherein the at least one peripheral edge 35 of each foam table piece 30 is mutually joinable at a mechanical snap joint 50 to form the cutting table 10 as depicted in FIG. 2. In some embodiments, the cutting table 10 includes exactly three of the foam table pieces 30, two of which that are designated as outside table pieces 34 that each have a first part 57 of the mechanical snap joint 50, and one that is designated a center table piece 36 that has two of a second part 52 of the mechanical snap joint 50, as seen in FIG. 3. The two outside table pieces 34 are fixed with the center table piece 36 by manually forcing the first part 57 of each mechanical snap joint 50 of the outside table piece 34 into the second part 52 of the mechanical snap joint 50 of the center table piece 36. As such, the cutting table 10 may be disassembled for facilitating storage and transport thereof, and then easily assembled at a workplace for use.

Figure 5A:
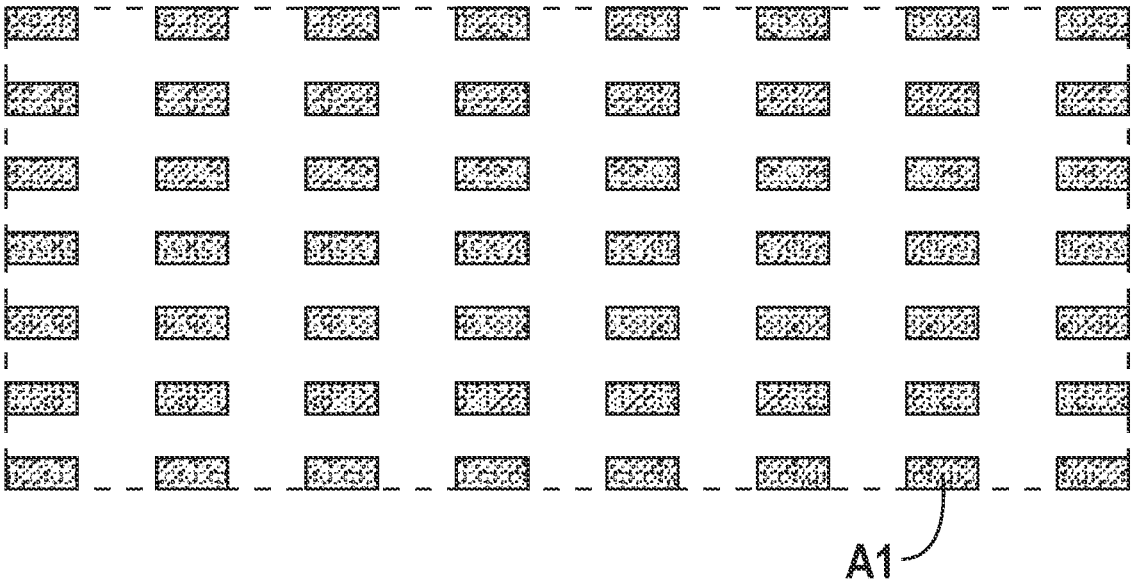
FIG. 5A shows a top plan view, showing a surface area of a top surface of a plurality of standoffs.
Figure 5B:
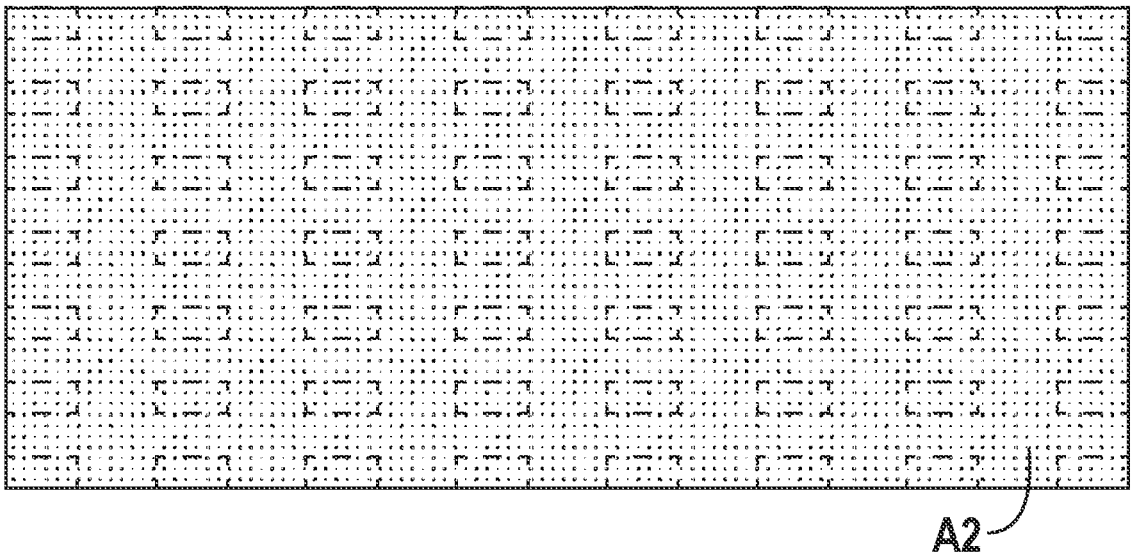
FIG. 5B shows a top plan view of a foam cutting table, showing a surface area of a top of the cutting table.

In some embodiments, a portion of an area $A_1$ (see FIG. 5A) of the top surfaces of the standoffs 40 to an area $A_2$ (see FIG. 5B) of the top side 38 of the foam table pieces 30 is less than 50%, such as between approximately 10% to approximately 40%, or between approximately 20% to approximately 30%, or between approximately 45% to approximately 50%.

Some embodiments of the cutting table 10 further include a pair of table legs 70 fixable at a top end 78 thereof with the bottom side 32 of at least one of the foam table pieces 30, whereby the cutting table 10 is supported on the support surface 18 by the table legs 70. In some embodiments, the table legs 70 each include at least one groove 80 adapted for receiving a bottom portion of a board of lumber 16, such as a standard 8-foot long 2×4. In such an embodiment, the at least one foam table piece 30 includes at least one inverted groove 85 adapted for receiving a corresponding top portion of the board of lumber 16 therein, whereby the at least one foam table piece 30 is stabilized on the table legs 70 and the support surface 18 and is secured against horizontal motion relative to the table legs 70 in at least one direction. In some embodiments, exactly two grooves 80 are included so that the cutting table 10 is stabilized by two of the boards of lumber 16. In some embodiments, the table legs 70 are also formed of a similar material as the foam table pieces 30 (e.g., EPS foam, XPS foam, etc.), providing a lightweight mechanism for supporting the foam table pieces 30.

Embodiments of the invention also include methods for forming a cutting table (e.g., the foam table pieces 30) from a block of foam material. The method generally forms two foam table pieces 30 simultaneously, with the standoffs 40 of one foam table piece 30 formed interlaced with the standoffs 40 of another foam table piece 30 as the forming process forms the two foam table pieces such that a first foam table piece is formed in an inverted relationship relative to a second foam table piece. In particular, a hot wire cutting tool is used to cut a series of linked and alternating (generally) horizontal and (generally) vertical cuts in the block of foam in one direction across, e.g., the width of the foam block. In some embodiments, a single contiguous series of cuts is used and the resulting foam table pieces 30 have a series of long ridges as the standoffs 40. A single planar cut then separates the second foam table piece 30 from the foam block. Notably, the two foam table pieces thus formed are capable of nesting within each other to minimize the storage and/or transportation volume occupied by the cutting table 10 when not in use.

In other embodiments, after the hot wire cutting tool is used to cut the series of linked and alternating horizontal and vertical cuts in the block of foam in one direction, the hot wire cutting tool is used to cut a second series of linked and alternating (generally) horizontal and (generally) vertical cuts in the block of foam in a second direction generally orthogonal to the first direction of cutting, and with the second sets of horizontal cuts falling in similar planes to the first sets of horizontal cuts. In this way, the standoffs 40 are formed having a generally truncated rectangular prism shape or a generally truncated square prism shape, as illustrated in the embodiments shown in FIGS. 1-5B. As may be appreciated, the second series of cuts may result in some waste foam material where no standoffs 40 are present.

In some embodiments of the method of forming the table pieces 30, the generally vertical cuts are formed at an angle of between approximately 0° and approximately 30° from orthogonal to the horizontal cuts. In other embodiments of the method of forming the table pieces 30, the generally vertical cuts are formed at an angle of between approximately 0° and approximately 45° from orthogonal to the horizontal cuts. Accordingly, embodiments of the invention embrace not only strictly orthogonal cuts forming the standoffs 40, but also standoffs 40 having sides at various angles to the top side 38 of the foam table pieces 30.

While a particular form of the invention has been illustrated and described, it will be apparent that various modifications can be made without departing from the spirit and scope of the invention. For example, the exact height and length of the foam table pieces 30 can be configured in multiple ways, and the cutting table 10 can be used, of course, for more than cutting wood. The standoffs 40 can take any suitable shape and height, and may vary by height in some embodiments to accommodate curved workpieces. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments. Aspects of the invention can be modified, if necessary, to employ the systems, functions, and concepts of the various references described above to provide yet further embodiments of the invention.

Changes can be made to the invention in light of the above Detailed Description section. While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A cutting table for supporting a workpiece while cutting the workpiece with a tool, comprising:

at least two table pieces that each comprises:

a body having a top side and a bottom side; and a plurality of standoffs comprising a grid of standoffs spaced in a pattern across the top side and integrally formed with the body of a common material with the body and projecting upwardly from the top side of the body and each standoff terminating at a generally common top plane, the standoffs being adapted for contacting and supporting a workpiece;

wherein the plurality of standoffs of each table piece is disposed in a complementary pattern such that standoffs of a first of the table pieces are spaced to fit in spaces between standoffs of a second of the table pieces when the second of the table pieces is inverted and disposed above the first of the table pieces, such that the standoffs of the first of the table pieces are adapted to nest among the standoffs of the second of the table pieces such that the first of the table pieces and the second of the table pieces are adapted to be nested atop one another having a combined thickness less than twice the thickness of one of the table pieces with its respective standoffs;

whereby with the workpiece supported on the standoffs, the workpiece may be cut with the tool, the workpiece supported by standoffs even if one or more of the standoffs has been damaged by the tool.

2. The cutting table as recited in claim 1, wherein the two or more standoffs comprise a stiff material providing minimal cutting resistance to the tool cutting the workpiece, whereby when the tool cutting the workpiece cuts into any of the standoffs, a portion of the standoff is sacrificed to the tool cutting the workpiece.

3. The cutting table as recited in claim 2, wherein the stiff material providing minimal cutting resistance comprises expanded polystyrene foam.

4. The cutting table as recited in claim 2, wherein the stiff material providing minimal cutting resistance comprises a material selected from the group consisting of polyisocyanurate foam, expanded polystyrene foam, extruded polystyrene foam, and a cellulosic-base elastic foam material.

5. The cutting table as recited in claim 1, wherein the entire of each of the at least two table pieces, comprises a stiff material providing minimal cutting resistance to the tool cutting the workpiece.

6. The cutting table as recited in claim 4, wherein the stiff material providing minimal cutting resistance comprises expanded polystyrene foam.

7. The cutting table as recited in claim 2, wherein the stiff material providing minimal cutting resistance comprises a material selected from the group consisting of polyisocyanurate foam, expanded polystyrene foam, extruded polystyrene foam, and a cellulosic-base elastic foam material.

8. The cutting table as recited in claim 1, wherein the standoffs are spaced generally equidistantly across the top side of each of the at least two table pieces.

9. The cutting table as recited in claim 1, wherein an area of the standoffs at the generally common top plane comprises between approximately 10% and approximately 40% of an area of the bottom side of each of the at least two table pieces.

10. The cutting table as recited in claim 1, wherein an area of the standoffs at the generally common top plane comprises between approximately 20% and approximately 30% of an area of the bottom side of each of the at least two table pieces.

11. The cutting table as recited in claim 1, wherein the table pieces having substantially equal thicknesses.

12. The cutting table as recited in claim 1, wherein:

each table piece comprises a part of a complementary snap joint along a peripheral edge thereof;

adjacent table pieces are adapted to snap together at their complementary snap joints; and when adjacent table pieces are snapped together at their complementary snap joints, the grid of standoffs of a first adjacent table piece extends into the grid of standoffs of a second adjacent table piece as a contiguous grid of standoffs.

13. The cutting table as recited in claim 12, further comprising:

a support surface adapted to support the adjacent table pieces in a substantially planar configuration; and one or more legs adapted to support the support surface above an underlying surface such that the generally common top plane of the standoffs is disposed at a convenient cutting height.

14. The cutting table as recited in claim 13, wherein:

each of the one or more legs comprises a channel sized and shaped to receive a first portion of a board of lumber therein to form the support surface; and each of the table pieces comprises a complementary channel formed in the bottom side thereof that is sized and shaped to receive a second portion of the board of lumber therein so as to secure the table pieces on the one or more legs against sliding motion in at least one generally horizontal direction.

15. A cutting table for supporting a workpiece above a support surface while cutting the workpiece with a tool, comprising:

three foam table pieces that each comprises:

a body comprising:

a top side;

a bottom side; and at least one peripheral edge comprising one part of a mechanical snap joint;

a plurality of standoffs integrally formed with and projecting upwardly from the top side and each standoff terminating at a generally common top plane, the standoffs adapted for contacting and supporting a workpiece;

wherein one of the three foam pieces comprises a second peripheral edge comprising one part of a mechanical snap joint such that the three foam table pieces can be joined at their respective parts of the mechanical snap joints to form a unitary foam table;

wherein the plurality of standoffs of at least two of the table pieces is disposed in a complementary pattern such that standoffs of a first of the table pieces are spaced to fit in spaces between standoffs of a second of the table pieces when the second of the table pieces is inverted and disposed above the first of the table pieces, such that the standoffs of the first of the table pieces are adapted to nest among the standoffs of the second of the table pieces such that the first of the table pieces and the second of the table pieces are adapted to be nested atop one another having a combined thickness less than twice the thickness of one of the table pieces with its respective standoffs;

whereby with the workpiece supported on the standoffs, the workpiece may be cut with the tool, the workpiece supported by standoffs even if one or more of the standoffs has been damaged by the tool.

16. The cutting table as recited in claim 15, further comprising:

a support surface adapted to support the adjacent table pieces in a substantially planar configuration; and one or more legs adapted to support the support surface above an underlying surface such that the generally common top plane of the standoffs is disposed at a convenient cutting height;

wherein each of the one or more legs comprises a channel sized and shaped to receive a first portion of a board of lumber therein to form the support surface; and wherein each of the table pieces comprises a complementary channel formed in the bottom side thereof that is sized and shaped to receive a second portion of the board of lumber therein so as to secure the table pieces on the one or more legs against sliding motion in at least one generally horizontal direction.

17. The cutting table as recited in claim 15, wherein each table piece, including the standoffs, is formed of expanded polystyrene foam.

18. A cutting table for supporting a workpiece while cutting the workpiece with a tool, comprising:

at least two table pieces of substantially equal thickness that each comprises:

a body having a top side and a bottom side; and a plurality of standoffs projecting upwardly from the top side of the body, the standoffs forming a grid of standoffs, each standoff terminating at a generally common top plane, and the standoffs being adapted for contacting and supporting a workpiece;

whereby with the workpiece supported on the standoffs, the workpiece may be cut with the tool, the workpiece supported by standoffs even if one or more of the standoffs has been damaged by the tool;

wherein each table piece comprises the standoffs disposed in a complementary pattern such that the standoffs of a first of the table pieces are spaced to fit in spaces between the standoffs of a second of the table pieces when the second of the table pieces is inverted and disposed above the first of the table pieces, such that the standoffs of the first of the table pieces are adapted to nest among the standoffs of the second of the table pieces such that the first of the table pieces and the second of the table pieces are adapted to be nested atop one another having a combined thickness less than twice the thickness of one of the table pieces with its respective standoffs.

19. The cutting table as recited in claim 18, wherein:

each table piece comprises a part of a complementary snap joint along a peripheral edge thereof;

adjacent table pieces are adapted to snap together at their complementary snap joints; and when adjacent table pieces are snapped together at their complementary snap joints, the grid of standoffs of a first adjacent table piece extends into the grid of standoffs of a second adjacent table piece as a contiguous grid of standoffs.

20. The cutting table as recited in claim 19, further comprising:

a support surface adapted to support the adjacent table pieces in a substantially planar configuration; and one or more legs adapted to support the support surface above an underlying surface such that the generally common top plane of the standoffs is disposed at a convenient cutting height.

21. The cutting table as recited in claim 20, wherein:

each of the one or more legs comprises a channel sized and shaped to receive a first portion of a board of lumber therein to form the support surface; and each of the table pieces comprises a complementary channel formed in the bottom side thereof that is sized and shaped to receive a second portion of the board of lumber therein so as to secure the table pieces on the one or more legs against sliding motion in at least one generally horizontal direction.

* * * * *